US006299043B1

(12) United States Patent
Griffin

(10) Patent No.: US 6,299,043 B1
(45) Date of Patent: Oct. 9, 2001

(54) HEAT INSULATING AND FIRE RESISTANT CONTAINER FOR STORING AND PROTECTING A LIFE LINE

(76) Inventor: Thomas J. Griffin, 14150 Griffin Farm La., Leesburg, VA (US) 20176

( * ) Notice: Subject to any disclaimer, the term of this patent is extended or adjusted under 35 U.S.C. 154(b) by 0 days.

(21) Appl. No.: 09/439,720

(22) Filed: Nov. 12, 1999

(51) Int. Cl.[7] ..... A45F 3/02

(52) U.S. Cl. ..... 224/616; 224/607; 224/680; 224/235; 224/271; 242/588.1; 206/389

(58) Field of Search ..... 224/580, 191, 224/607, 616, 680, 682, 235, 271; 242/588.1; 206/389, 397; 169/48, 26, 54; 383/61, 110, 113; 190/119, 125, 903

(56) References Cited

U.S. PATENT DOCUMENTS

| | | | | |
|---|---|---|---|---|
| 3,292,748 | | 12/1966 | Rifkin . | |
| 3,637,000 | | 1/1972 | Walger . | |
| 4,232,808 | * | 11/1980 | Gray | 224/205 |
| 4,240,363 | | 12/1980 | Troy . | |
| 4,424,841 | | 1/1984 | Smith . | |
| 4,593,815 | * | 6/1986 | Wright | 206/389 |
| 4,844,373 | * | 7/1989 | Fike, Sr. | 242/588.1 |
| 5,056,603 | | 10/1991 | Parkinson . | |
| 5,419,275 | * | 5/1995 | Wood | 114/311 |
| 5,748,089 | | 5/1998 | Sizemore . | |
| 5,896,962 | | 4/1999 | Smith . | |
| 5,915,608 | * | 6/1999 | Mao | 224/257 |

* cited by examiner

*Primary Examiner*—Stephen K. Cronin
(74) *Attorney, Agent, or Firm*—Raymond A. Nuzzo

(57) ABSTRACT

A heat insulating and fire resistant container for storing and protecting a life line, comprising (a) a bottom section fabricated from heat insulating, fire resistant material, (b) a continuous wall section fabricated heat insulating, fire resistant material and having a first end and a second end, the bottom section being attached to the first end of the wall section, the wall section having an interior side and an exterior side, the bottom section and wall section cooperating to define an interior compartment for receiving a life line, (c) means for securing one end of the life line to the container; and (d) closure means for closing the interior compartment.

23 Claims, 5 Drawing Sheets

HEAT INSULATING AND FIRE RESISTANT CONTAINER FOR STORING AND PROTECTING A LIFE LINE

BACKGROUND OF THE INVENTION

1. Field of the Invention

The present invention generally relates to a heat insulating and fire resistant container for storing and protecting a life line which can be used by fire-fighting, police and military personnel.

2. Problem to be Solved

Life lines (also known as personal escape ropes) are typically used by fire-fighting personnel, police SWAT units and even special units of the armed forces. Life lines are typically used in situations where it is necessary to quickly descend from a particular location to another location that is lower in elevation. For example, fire-fighting personnel may have to quickly descend from a burning floor of a high-rise structure to a lower floor that is not on fire.

Conventional carrying bags that are used to carry and store life lines are relatively large and bully. Such carrying bags are typically fabricated from Nylon Cordura™ or other materials that can actually melt when subjected to intense heat and fire. Some of these carrying bags are up to about 30 inches in length. Thus, it is also very difficult for fire-fighting personnel to carry such a bag since fire-fighting personnel have to carry other vital equipment such as an air-pack, hoses, medical equipment, tools, etc. Since it is not possible to carry such a large bag, fire-fighting personnel may place the bag away from themselves as they are battling a blaze. Therefore, it is very easy for the fire-fighting personnel to become separated from the bag and unable to retrieve the bag due to the hazardous environment.

It is therefore an object of the present invention to provide a heat insulating and fire resistant container for storing and protecting a life line that solves the problems discussed above.

Still other objects and advantages of the present invention will in part be obvious and will in part be apparent from the specification.

SUMMARY OF THE INVENTION

The present invention is directed, in a first aspect, a heat insulating and fire resistant container for storing and protecting a life line, comprising (a) a bottom section fabricated from heat insulating, fire resistant material, (b) a continuous wall section fabricated heat insulating, fire resistant material and having a first end and a second end, the bottom section being attached to the first end of the wall section, the wall section having an interior side and an exterior side, the bottom section and wall section cooperating to define an interior compartment for receiving a life line, (c) means for securing one end of the life line to the container; and (d) closure means for closing the interior compartment.

In one embodiment of the present invention, the wall and bottom sections of the heat insulating and fire resistant container are configured to provide the container with a substantially rectangular shape wherein the wall section comprises a pair of lengthwise wall sections and a pair of widthwise wall sections. In such an embodiment, each of the lengthwise and widthwise wall sections has a first end attached to the bottom section and a second end that forms a portion of the perimeter of the interior compartment opening. The container further comprises a rigid frame conforming to and attached to the container adjacent to the perimeter of the interior compartment opening.

In one embodiment, the closure means comprises (a) a main flap attached to the second end of one of the lengthwise wall sections and extending over the interior compartment opening, the main flap having a portion that extends downward over a portion of the other lengthwise wall section, (b) a pair of flaps, each side flap attached to the second end of a corresponding widthwise wall section, (c) and means for removably attaching the portion of the main flap to the second lengthwise wall section.

In a further embodiment, the wall and bottom sections of the heat insulating and fire resistant container are configured to provide the container with a substantially cylindrical shape. In this embodiment, wall section has a first end attached to the bottom section and a second end that defines the interior compartment opening, the closure means comprises (a) a draw cord movably attached to the container adjacent the interior compartment opening, the draw cord having a pair of ends that, when simultaneously pulled in the same direction and away from the container, tighten the draw cord so as to close the interior compartment opening, (b) and a draw cord adjusting means for regulating the amount of draw cord about the compartment interior opening so as to allow the interior compartment opening to be enlarged or reduced.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which.

DETAILED DESCRIPTION OF THE INVENTION

Figures 1, 2, 3:
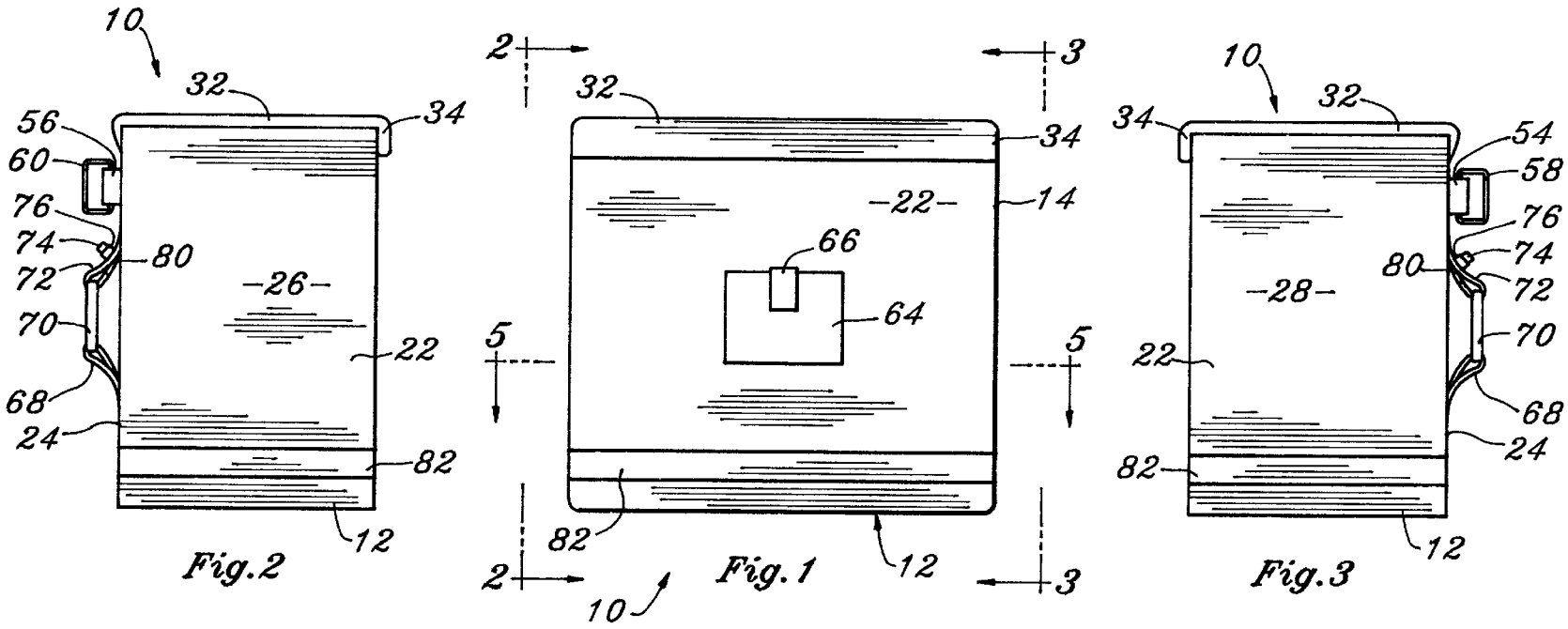
FIG. 1 is a front elevational view of one embodiment of the heat insulating and fire resistant container of the present invention.
FIG. 2 is a side elevational view taken along line 2—2 of FIG. 1.
FIG. 3 is a side elevational view taken along line 3—3 of FIG. 1.
Figure 4:
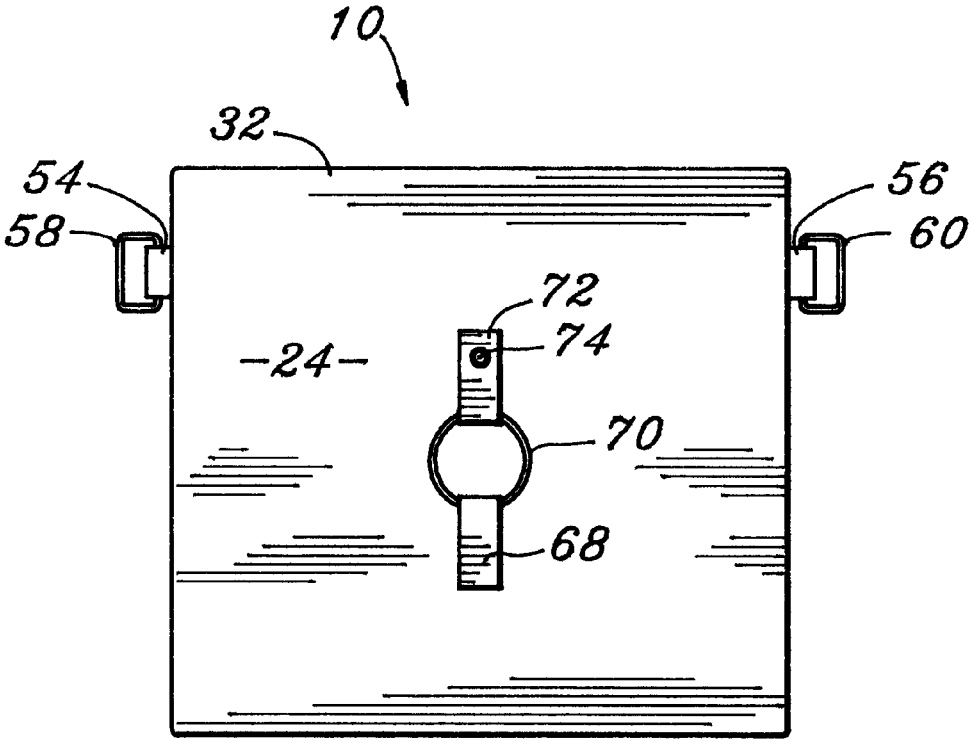
FIG. 4 is a rear elevational view of the heat insulating and fire resistant container of FIG. 1.

In describing the preferred embodiments of the present invention, reference will be made herein to FIGS. 1–11 of the drawings in which like numerals refer to like features of the invention.

Referring to FIGS. 1–6, heat insulating and fire resistant container 10 of the present invention generally comprises a bottom section 12 fabricated from heat insulating, fire resistant material and a continuous wall section 14 that is also fabricated heat insulating, fire resistant material. Wall section 14 has a top end and a bottom end. Bottom section 12 is attached to the bottom end of wall section 14. Wall section 14 has an interior side 16 and exterior side 18. Bottom section 12 and wall section 14 cooperate to define an interior compartment 20 for storing and protecting a life line (not shown). In one embodiment, stitching is used to attach the bottom and wall sections 12 and 14, respectively, together. In a preferred embodiment, the stitching used is fabricated from fire resistant material.

Figure 5:
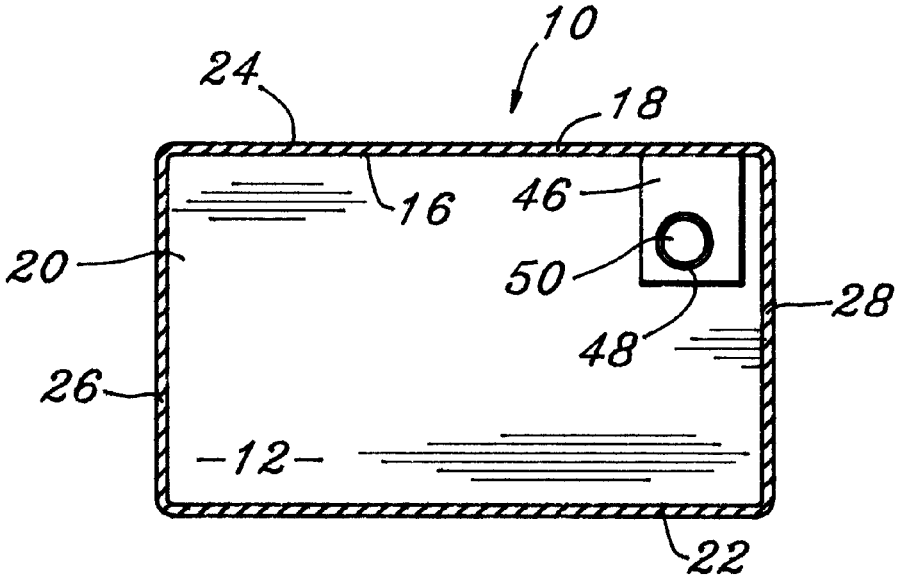
FIG. 5 is a cross-sectional view taken along line 5—5 of FIG. 1.
Figure 6:
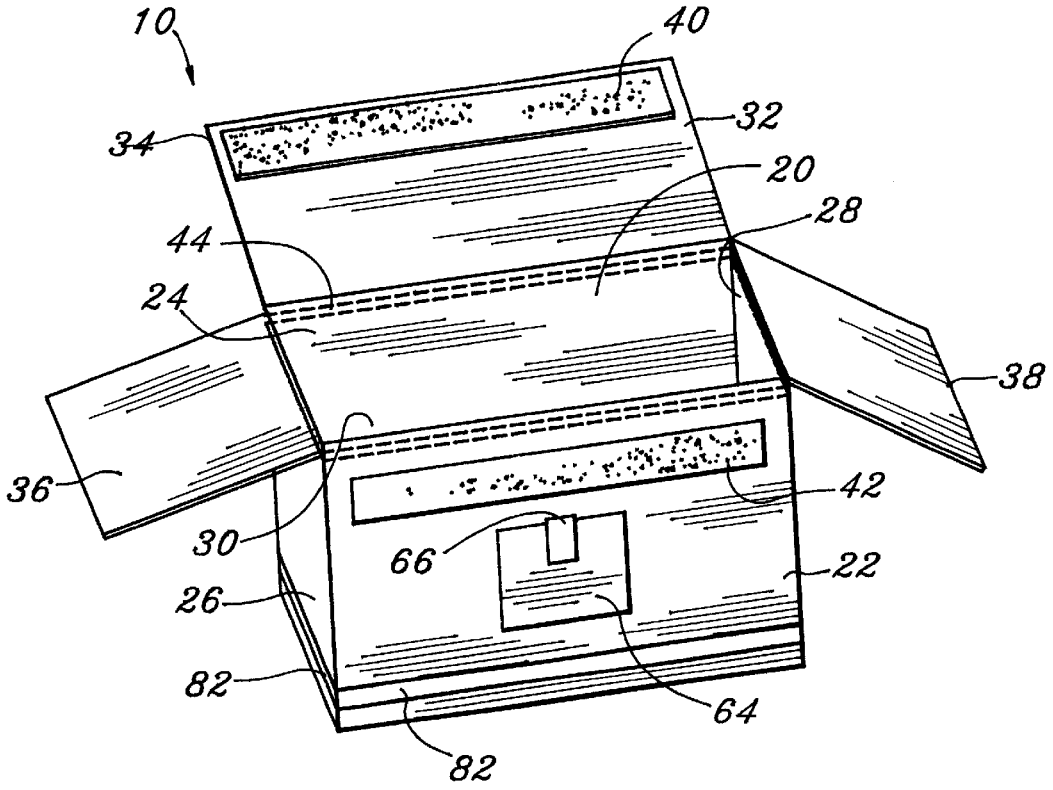
FIGS. 6 and 7 are perspective views of the heat insulating and fire resistant container of FIG. 1.

Referring to FIGS. 1–6, in one embodiment, bottom section 12 and wall section 14 are configured to provide container 10 with a substantially rectangular shape. In such a configuration, wall section 14 comprises a pair of lengthwise wall sections 22 and 24 and a pair of widthwise wall sections 26 and 28. Each of the lengthwise wall sections 22 and 24 and widthwise wall sections 26 and 28 has a bottom end attached to bottom section 12 and a top end that forms a portion of the perimeter of opening 30 of interior compartment 20. Container 10 comprises a main flap 32 that is attached to the top end of lengthwise wall section 24 and extends over the opening 30 of the interior compartment 20. Main flap 32 has portion 34 that extends downward over a portion of lengthwise wall section 22. Container 10 further comprises side flaps 36 and 38. Side flap 36 is attached to top end of widthwise wall section 26. Similarly, side flap 38 is attached to the top end of widthwise wall section 28. Container 10 further includes a complementary fastening system for removably attaching portion 34 of main flap 32 to lengthwise wall section 22. The complementary fastening system comprises a pair of complementary portions that are configured for interconnections to one another. Referring to FIG. 6, one complementary portion 40 is attached to main flap 32 and the other complementary portion 42 is attached to the lengthwise wall section 22. In one embodiment, the complementary fastening system comprises fire resistant VelcroT™ strips. Specifically, portion 40 is configured as one complementary portion of the Velcro™ fastening system and portion 42 is configured as the other complementary portion of the Velcro™ fastening system. In another embodiment, the complementary fastening system comprises a snap configuration wherein a male snap portion is attached to main flap portion 34 and a female snap portion is attached to wall section 22. Other types of complementary fastening systems can be used.

In one embodiment, container 10 further comprises rigid frame 44 (shown in phantom) that is attached to the container adjacent to the perimeter of opening 30. In such an embodiment, each top end of wall sections 22, 24, 26 and 28 are folded over itself and secured with stitching to form a continuous pocket that extends for the entire perimeter of opening 30 and is sized to receive frame 44. Frame 44 facilitates insertion and removal of the life line into and from, respectively, interior compartment 20.

In a preferred embodiment, heat insulating and fire insulating material from which container 10 is fabricated is NOMEX™ which is manufactured by DuPont Canada Inc. In an alternate embodiment, heat insulating and fire insulating material from which container 10 is fabricated is PBI GOLD™ manufactured by Hoechst Celanese Corporation. In yet another embodiment, the heat insulating and fire insulating material from which container 10 is fabricated is a blend or combination of NOMEX™ and PBI GOLD™. In a preferred embodiment, the heat insulating and fire insulating material from which container 10 is fabricated is also water resistant.

Referring to FIG. 5, container 10 further comprises member 46 located within the interior 20 and attached to bottom section 12. Member 46 has grommet 48 formed therein. Grommet 48 has opening 50 that is sized for receiving a life line. In a preferred embodiment, member 46 is fabricated from heat and fire resistant material and grommet 48 is fabricated from metal. Prior to disposing a life line into interior 20, the user first inserts one end of the life line into opening 50 of grommet 48 and ties a knot (e.g. fisherman's knot) so that the end of the line is secured to member 46. The user then inserts the entire life line into container 10. In one embodiment, member 46 is attached to either bottom section 12 or wall section 24 with stitching.

Referring to FIGS. 2, 3, 4 and 7, in one embodiment, container 10 includes a pair of loops 52 and 54 that are attached to exterior side 18 of container 10. Container 10 further includes rings 58 and 60 that are mounted to loops 52 and 54, respectively, and attached to shoulder strap 62. In one embodiment, shoulder strap 62 is fabricated from Nylon. In another embodiment, each end of shoulder strap 62 is attached to a plastic fastener that is removably attached to a corresponding ring 58 and 60. In such an embodiment, shoulder strap 62 can be removably attached to container 10. Furthermore, the user can easily break the plastic fasteners if shoulder strap 62 should become snagged or caught on another object.

Container 10 comprises at least one pocket 64 formed on exterior side 18 of wall section 22 that is sized for receiving a carabiner-type fastener of other type of fasteners, e.g. "figure eight" fastener. Flap 66 has one end attached to wall section 22 and another end removably attached to pocket 64 so as to allow pocket 64 to be opened or closed. A fire-resistant Velcro™ fastening system is used to removably attach flap 66 to pocket 64.

Container 10 further comprises loop 68, ring 70 and strap member 72. Loop 68 is attached to exterior side 18 of wall section 24. One end of strap member 72 is attached to exterior side 18 of wall section 24. Ring 70 is movably attached to loop 68. Strap member 72 is inserted through ring 70 and is folded over itself and removably attached to itself with a complementary fastening system. In one embodiment, the complementary fastening system comprises a snap configuration comprising male snap portion 74 and female snap portion 76. Other types of complementary fastening systems can be used.

Strap member 72 and snap portions 74 and 76 allow container 10 to be removably attached to a user's belt (not shown). Specifically, if container 10 is used by fire-fighting personnel, strap member 72 and snap portions 74 and 76 allow container 10 to be attached to an air pack, belt, web belt, vest, etc. and then quickly removed from the user's belt, etc. by disengaging male snap portion 74 from female snap portion 76. Loop 68, ring 70 and strap member 72 are positioned so as to prevent any significant amount of weight from being exerted or applied directly to snap portions 74 and 76. In one embodiment, a layer of leather is applied to surface 80 of member 72 since surface 80 will be subject to wear due to its constant frictional contact with ring 70 and a user's belt, vest, etc.

Referring to FIGS. 1, 2, 3 and 6, container 10 further comprises reflective member 82 attached to exterior wall sections 22, 26 and 28 for reflecting light and enabling a user to identify container 10 in a dark or smoky environment.

An important advantage of container 10 is its relatively small size and compactness. In one embodiment, container 10 has a length of about 8 (eight) inches, a width of about 3½ (three and one-half) inches, and a height of about 10 (ten) inches. However, it is to be understood that container 10 can be configured to have other dimensions.

Figure 8:
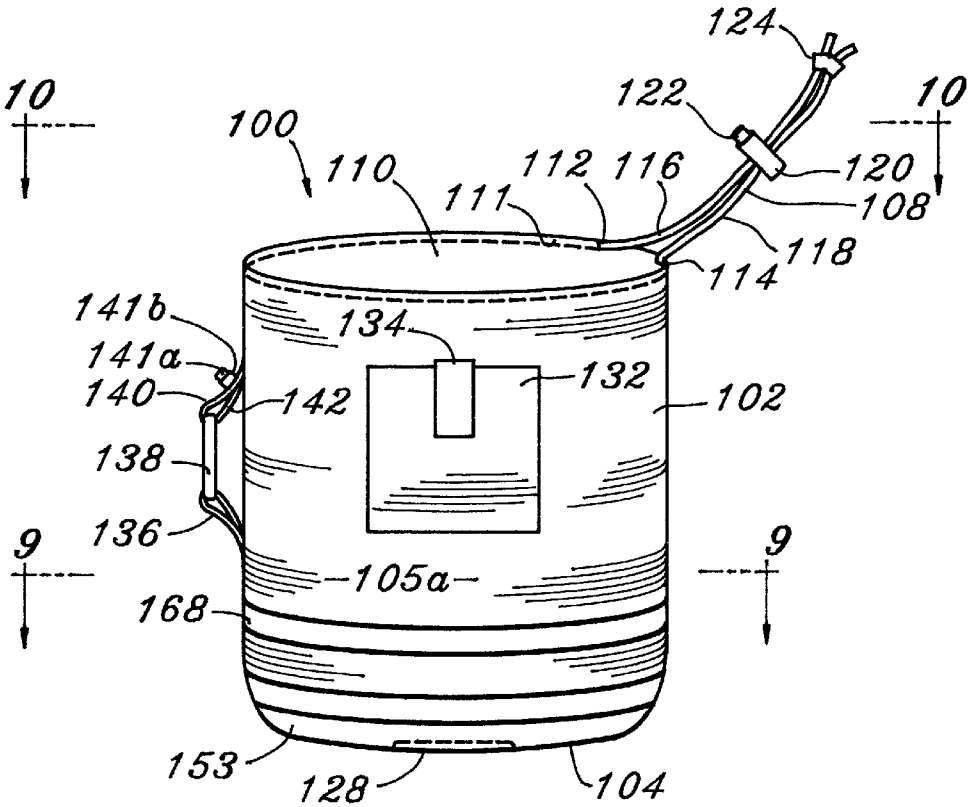
FIG. 8 is a front elevational view of another embodiment of the heat insulating and fire resistant container of the present invention.

Referring to FIG. 8, in an alternate embodiment, the heat insulating and fire resistant container of the present is configured to have a generally cylindrical shape. Such a container is shown as container 100 which generally comprises continuous wall section 102 and bottom section 104 that is attached to wall portion 102. In one embodiment, stitching is used to attach wall section 102 to bottom section 104. In a preferred embodiment, the stitching used is fabricated from fire resistant material. Wall section 102 has an exterior side 105*a* and interior side 105*b*.

Figure 9:
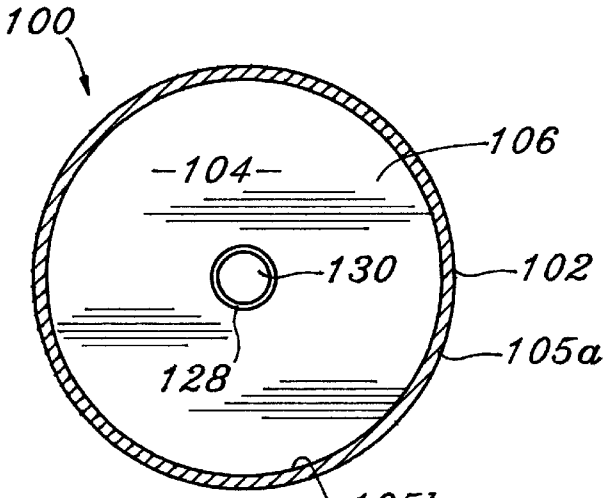
FIG. 9 is a cross-sectional view taken along line 9—9 of FIG. 8.
Figure 10:
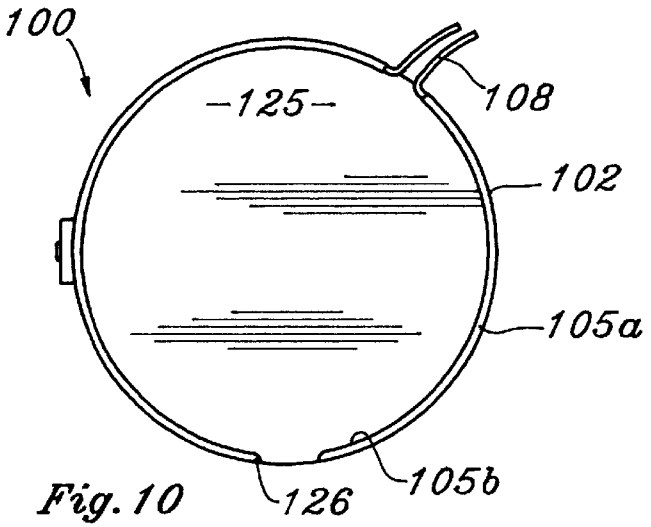
FIG. 10 is a top plan view taken along line 10—10 of FIG. 8.
Figure 11:
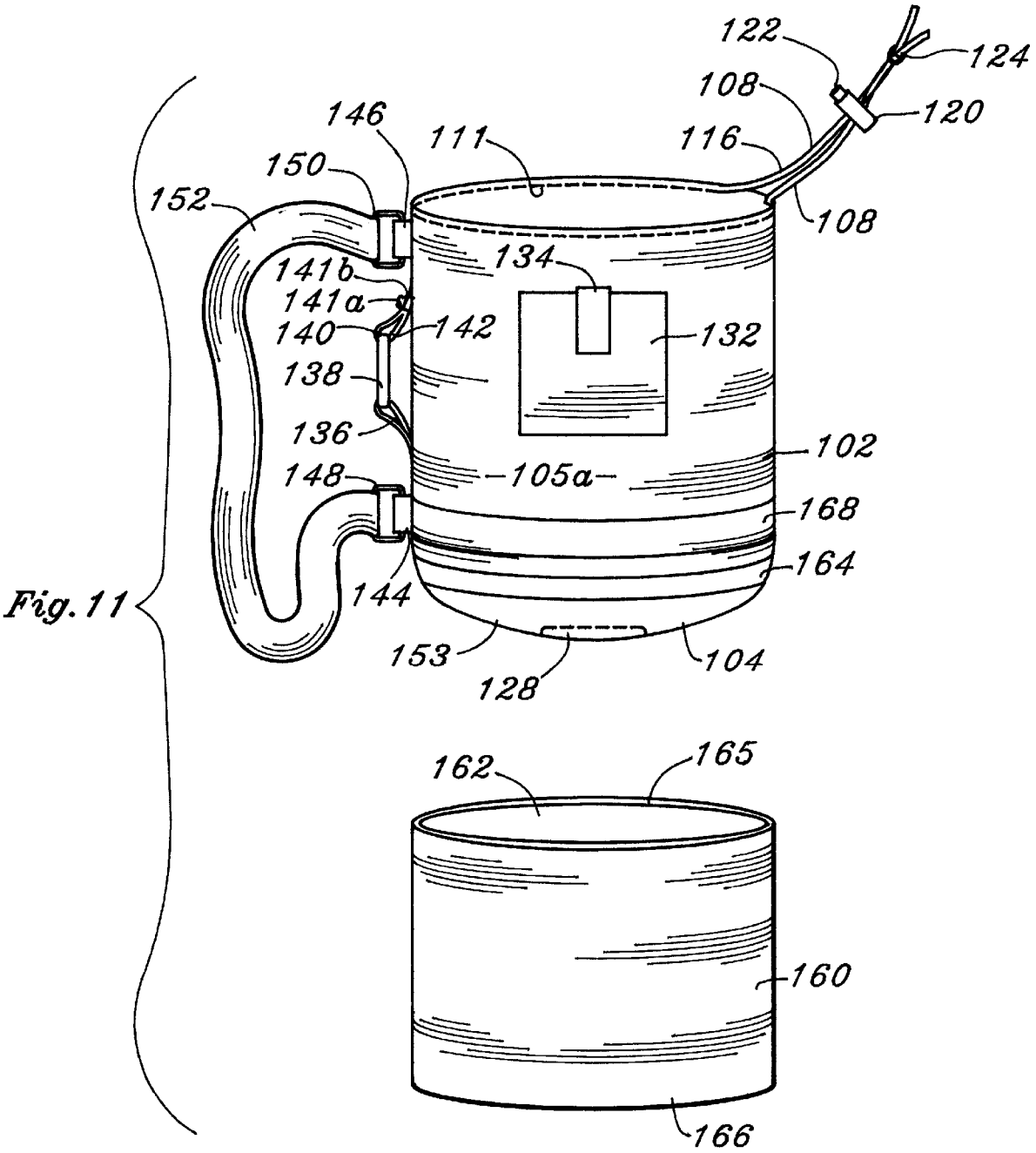
FIG. 11 is an exploded, front elevational view of the heat insulating and fire resistant container of FIG. 8 showing an optional shoulder strap and a cover for covering the bottom section of the container.

Referring to FIG. 8, 9 and 10, wall section 102 and bottom section 104 define interior compartment 106 that covers the life line. Container 100 further includes draw cord 108 movably attached to container 100 and positioned adjacent compartment interior opening 110. In one embodiment, the top end of wall section 102 is folded about itself and secured with stitching to form pocket 111 (shown in phantom) that extends about the perimeter of the top end of wall section 102. Draw cord 108 is movably disposed within pocket 111. Openings 112 and 114 are formed in pocket 111 so as to allow end portions 116 and 118 of draw cord 108 to extend therefrom. When end portions 116 and 118 are simultaneously pulled in the same direction and away from the container 100, opening 110 is reduced in size. If a tensile force is exerted on wall section 102 such that diametrically positioned portions of wall section 102 (adjacent opening 110) are pulled in opposite directions, then opening 110 is enlarged due the maneuverability of draw cord 108 within pocket 111. Draw cord lock 120 allows a user to adjust or regulate the amount of draw cord 108 that is disposed within pocket 111 thereby allowing the opening 110 to be enlarged or reduced in accordance with the user's needs. Draw cord lock 120 has portion 122 that is movably attached to portion 120. Portion 120 has an opening for receiving the end portions 116 and 118 of draw cord 108. When portion 120 is moved into a first position, end portions 116 and 118 of draw cord 108 can pulled through the opening in portion 120 in either direction so as to allow opening 110 to be enlarged or reduced in size. When portion 122 is in a second position, end portions 116 and 118 of draw cord 108 are restrained from movement. In a preferred embodiment, portion 122 is spring biased in the second position. In one embodiment, draw cord 108 has a diameter of about 3 mm (millimeter). In a preferred embodiment, a knot 124 is formed with end portions 116 and 118 on the other side of lock 120 as shown in FIGS. 8 and 11. Knot 124 prevents lock 120 from being dismounted from end portions 116 and 118 of cord 108.

Referring to FIG. 10, container 100 further comprises flap 125 attached to the interior side 105*b* of wall section 102 just below opening 110 for covering and protecting a life line stored within interior compartment 106. In one embodiment, cover 125 is fabricated from leather. Cover portion 125 has portion 126 that is attached to interior side 105*b*. In a preferred embodiment, fire resistant stitching is used to attach portion 126 to interior side 105*b*.

Referring to FIG. 9, container 100 further includes grommet 128 located in bottom section 104 (also shown in phantom in FIGS. 8 and 11). Grommet 128 has opening 130 through which a portion of the life line is inserted so as to allow that portion of the life line to protrude from bottom section 104. During use, the user preferably ties a pair of knots (e.g. fisherman's knot) in the life line such that one knot is on the exterior side of grommet 128 (i.e. on the exterior of bottom section 104) and the other knot is within the interior compartment 106 and is adjacent grommet 128. In a preferred embodiment, grommet 128 is fabricated from metal. In an alternate embodiment, grommet 128 is not formed in bottom section 104. Instead, a member similar to member 46 (see FIG. 5) is located within the interior compartment 106 and is attached to either interior side 105*b* of wall section 102 or bottom section 104.

Referring to FIGS. 8 and 11, container 100 further comprises pocket 132 and flap 134 that are constructed and function in the same manner as pocket 64 and flap 66, respectively (see FIG. 7) previously discussed herein.

Container 100 also comprises loop member 136, ring 138 and strap member 140. Loop 136 is attached to exterior side 105*a* of wall section 102. One end of strap member 140 is attached to exterior side 105*a* of wall section 102. Ring 138 is movably attached to loop 136. Strap member 140 is inserted through ring 138 and is folded over itself and removably attached to itself with a complementary fastening system. In one embodiment, the complementary fastening system comprises a snap configuration comprising male snap portion 141*a* and female snap portion 141*b*. Other types of complementary fastening systems can be used.

Strap member 140 and snap portions 141*a* and 141*b* allow container 100 to be removably attached to a user's belt (not shown). Specifically, in the case of fire-fighting personnel, strap member 140 and snap portions 141*a* and 141*b* allow container 100 to be attached to an air pack, belt, web belt, vest, etc. and then quickly removed from the user's belt, etc. by disengaging male snap portion 141*a* from female snap portion 141*b*. Loop 136, ring 138 and strap member 140 are positioned so as to prevent any significant amount of weight from being exerted or applied directly to snap portions 141*a* and 141*b*.

In one embodiment, a layer of leather is applied to surface 142 of member 140 since surface 142 will be subject to wear due to its constant frictional contact with ring 138 and a user's belt, vest, etc.

Referring to FIG. 11, In one embodiment, container 100 includes a pair of loops 144 and 146 that are attached to the exterior side 105*a* of container 100 and rings 148 and 150 that are attached to loops 144 and 146, respectively. Rings 148 and 150 are attached to shoulder strap 152 as shown in FIG. 11. In an alternate embodiment, shoulder strap 152 includes plastic fasteners that are removably secured to rings 148 and 150. In such an embodiment, shoulder strap 152 is removably attached to container 100. Furthermore, the user can easily break the plastic fasteners if shoulder strap 152 should become snagged or caught on another object.

In one embodiment, a layer of leather is attached to the exterior side 153 of bottom section 104 since that portion of container 100 will most likely be subject to the most wear.

Referring to FIG. 11, container 100 further comprises cover 160 for covering exterior side 153 of bottom section 104 so as to protect and conceal grommet 128 and any portion of the life line extending therethrough. Cover 160 has interior 162 that is sized to receive bottom section 104. Cover 160 is removably attached to bottom section 104. In one embodiment, fire resistant Velcro™ strips 164 and 165 are used to removably attach cover 160 to bottom section 104. In a preferred embodiment, cover 160 is fabricated from fire resistant material. In one embodiment, a layer of leather is attached to bottom exterior side 166 of cover 160 since that portion of cover 160 will most likely be subject to the most wear.

Figure 7:
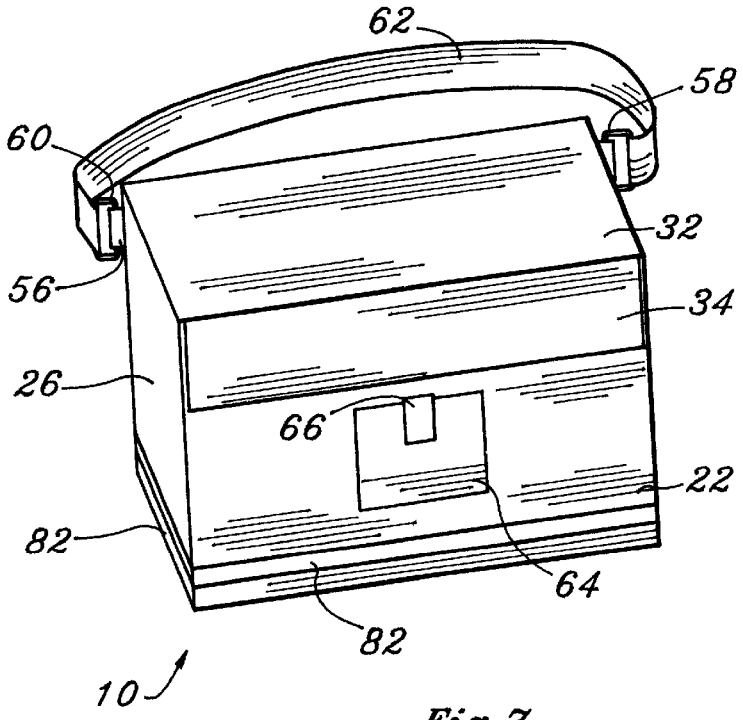

Referring to FIGS. 1 and 11, container 100 includes reflective stripe 168 that functions in the same manner as stripe 82 (see FIG. 7).

An important advantage of container 100 is its relatively small size and compactness. In one embodiment, container 100 has height of about 10 (ten) inches, and a diameter of about 5 (five) inches. However, it is to be understood that container 100 can be configured to have other dimensions.

Containers 10 and 100 can be configured in different sizes and shapes to accommodate life lines of different lengths and diameters. For example, containers 10 and 100 can be configured to receive life lines that have lengths of between about 40 feet and 100 feet. However, containers 10 and 100 can be configured to receive life lines that are less than 40 feet or more than 100 feet in length. Furthermore, the containers 10 and 100 are configured to store a life line which has a carabiner attached thereto.

It is to be understood that where leather is applied to portions of containers 10 and 100 as described above, such leather is applied over the heat insulating and fire resistant material.

In order to use the life line stored in containers 10 and 100, the user (a) disengages strap member 72 from ring 70 so as to remove container 10 from his or her belt, air pack, or vest. In a similar manner the user would disengage strap member 140 from ring 138, respectively, so as to remove container 100 from his or her belt, etc.;

(b) removes the portion of the life line having the carabiner attached thereto from the container 10 or 100;

(c) hurls or drops container 10 or 100 off the side of the burning structure (i.e. out a window or from a landing, staircase, etc.) so that the rest of the life line comes out of container 10 or 100;

(d) wraps the end of the life line having the carabiner around an object that can function as an anchor (e.g. column, post, wall joist, railing, etc.) and then fastens the carabiner to the life line;

(e) removes the "figure eight" fastener from pockets 64 or 132 and fastens the line to the "figure eight" fastener;

(f) then fastens the "figure eight" fastener to his or her rated rappelling belt; and (g) descends down the side of the burning structure wherein one of the user's hands grasps the life line in front of the user, and the other user's hand is positioned behind the user so as to grasp and feed the life line through the "figure eight" fastener to allow a careful, steady and safe descent.

Thus, heat insulating and fire resistant containers 10 and 100 of the present invention provide significant advantages. Specifically, containers 10 and 100 of the present invention:

(a) are resistant to heat and fire thereby protecting the life line stored therein;

(b) are light, compact and easy to carry or attach to belts, vests, air-packs, etc.

(c) can be easily and quickly separated from the user;

(d) can be readily identified in a smoky or dark environment; and (e) can be manufactured with commercially available materials and at reasonable costs.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A heat insulating and fire resistant container for storing and protecting a life line, comprising:

a bottom section fabricated from heat insulating, fire resistant material;

a continuous wall section fabricated heat insulating, fire resistant material and having a first end and a second end, the bottom section being attached to the first end of the wall section, the wall section having an interior side and an exterior side, the bottom section and wall section cooperating to define an interior compartment for receiving a life line;

means for securing one end of the life line to the container; and closure means for closing the interior compartment.

2. The heat insulating and fire resistant container according to claim 1 further comprising at least one pocket formed on the exterior side of the wall that is sized for receiving a carabiner.

3. The heat insulating and fire resistant container according to claim 1 wherein the heat insulating and fire resistant material is fabricated is chosen from NOMEX™ and PBI GOLD™.

4. The heat insulating and fire resistant container according to claim 1 further comprising a reflective member attached to a portion of the wall section for reflecting light and enabling a user to identify the container in a dark environment.

5. The heat insulating and fire resistant container according claim 1 further comprising means for removably attaching a shoulder strap to the container.

6. The heat insulating and fire resistant container according claim 3 wherein the shoulder strap is fabricated from nylon.

7. The heat insulating and fire resistant container according to claim 1 further comprising means for removably attaching the container to a wearer's belt.

8. The heat insulating and fire resistant container according to claim 7 wherein the removably attaching means comprises a quick-release device that allows a wearer to quickly separate the container from the wearer.

9. The heat insulating and fire resistant container according to claim 1 wherein the wall and bottom sections are configured to provide the container with a substantially rectangular shape wherein the wall section comprises a pair of lengthwise wall sections and a pair of widthwise wall sections.

10. The heat insulating and fire resistant container according to claim 9 wherein each of the lengthwise and widthwise wall sections has a first end attached to the bottom section and a second end that forms a portion of the perimeter of the interior compartment opening, the container further comprising a rigid frame attached to the container adjacent to the perimeter of the interior compartment opening.

11. The heat insulating and fire resistant container according to claim 10 wherein the closure means comprises:

a main flap attached to the second end of one of the lengthwise wall sections and extending over the interior compartment opening, the main flap having a portion that extends downward over a portion of the other lengthwise wall section;

a pair of flaps, each side flap attached to the second end of a corresponding widthwise wall sections;

means for removably attaching the portion of the main flap to the second lengthwise wall section.

12. The heat insulating and fire resistant container according to claim 11 wherein the removably attaching means comprises a pair of complementary portions that are configured for interconnection to one another, one complementary portion being attached to the main flap, the other complementary portion being attached to the other lengthwise wall section.

13. The heat insulating and fire resistant container according to claim 1 wherein the wall and bottom sections are configured to provide the container with a substantially cylindrical shape.

14. The heat insulating and fire resistant container according to claim 13 wherein the wall section has a first end attached to the bottom section and a second end that defines the interior compartment opening, the closure means comprising:

a draw cord movably attached to the container adjacent the interior compartment opening, the draw cord having a pair of ends that, when simultaneously pulled in the same direction and away from the container, tighten the draw cord so as to reduce the interior compartment opening; and a draw cord adjusting means for regulating the amount of draw cord about the interior compartment opening so as to allow the interior compartment opening to be enlarged or reduced in size.

15. The heat insulating and fire resistant container according claim 13 further comprising a flap attached to the interior side of the wall section just below the interior compartment opening for covering and protecting a life line stored within the interior compartment.

16. The heat insulating and fire resistant container according to claim 15 wherein the cover is fabricated from leather.

17. The heat insulating and fire resistant container according to claim 1 wherein the heat and fire insulating material is water resistant.

18. The heat insulating and fire resistant container according to claim 17 wherein the securing means comprises a member located within the interior compartment and attached to bottom section, the member having a grommet formed therein that is sized for insertion therethrough of a life line.

19. The heat insulating and fire resistant container according to claim 18 wherein the member is fabricated from heat and fire resistant material.

20. The heat insulating and fire resistant container according to claim 18 wherein the grommet is fabricated from metal.

21. The heat insulating and fire resistant container according to claim 17 wherein the securing means comprises a grommet located in the bottom section of the container through which the end of life line can be inserted.

22. The heat insulating and fire resistant container according to claim 21 wherein the grommet is fabricated from metal.

23. The heat insulating and fire resistant container according to claim 21 further comprising a cover removably attached to the bottom section so as to protect and conceal the grommet and any portion of the life line extending therethrough, the cover being fabricated from heat and fire resistant material.

* * * * *

UNITED STATES PATENT AND TRADEMARK OFFICE

CERTIFICATE OF CORRECTION

PATENT NO. : 6,299,043 B1
DATED : October 9, 2001
INVENTOR(S) : Griffin

It is certified that error appears in the above-identified patent and that said Letters Patent is hereby corrected as shown below:

Column 8,
Line 2, delete "3" and substitute therefor -- 5 --.
Line 3, delete "is fabricated".

Signed and Sealed this

Seventh Day of May, 2002

*Attest:*

*Attesting Officer*

JAMES E. ROGAN
*Director of the United States Patent and Trademark Office*